US007134807B2

(12) United States Patent
Dreyer

(10) Patent No.: US 7,134,807 B2
(45) Date of Patent: Nov. 14, 2006

(54) SUBMERSIBLE BOOM GATE

(75) Inventor: Harold B. Dreyer, Anchorage, AK (US)

(73) Assignee: Gunderboom, Inc., Anchorage, AK (US)

( * ) Notice: Subject to any disclaimer, the term of this patent is extended or adjusted under 35 U.S.C. 154(b) by 0 days.

(21) Appl. No.: 11/096,033

(22) Filed: Mar. 31, 2005

(65) Prior Publication Data

US 2005/0252047 A1 Nov. 17, 2005

Related U.S. Application Data

(60) Provisional application No. 60/557,995, filed on Mar. 31, 2004.

(51) Int. Cl.
*E02B 15/06* (2006.01)

(52) U.S. Cl. ..... 405/64; 405/68

(58) Field of Classification Search ..... 405/63, 405/64, 65, 66, 67, 68, 69
See application file for complete search history.

(56) References Cited

U.S. PATENT DOCUMENTS 3,779,020 A * 12/1973 Muramatsu et al. ..... 405/64
3,859,796 A * 1/1975 Benson ..... 405/64
3,922,861 A * 12/1975 Grihangne ..... 405/64
3,984,987 A * 10/1976 Light, Jr. ..... 405/63
4,573,426 A * 3/1986 Larsson ..... 405/68
5,102,261 A 4/1992 Gunderson, III
5,154,537 A * 10/1992 DeVries et al. ..... 405/63
5,810,512 A * 9/1998 Kateley ..... 405/64
6,485,229 B1 11/2002 Gunderson, III et al.
6,514,010 B1 2/2003 Dreyer
6,567,341 B1 5/2003 Dreyer et al.
6,660,170 B1 12/2003 Dreyer et al.
6,739,801 B1 5/2004 Dreyer
6,743,367 B1 6/2004 Dreyer
6,848,861 B1 2/2005 Dreyer
6,857,819 B1 2/2005 Gunderson, III
2003/0010727 A1 1/2003 Gunderson, III
2003/0089658 A1 5/2003 Dreyer et al.
2004/0197149 A1 10/2004 Dreyer
2005/0117973 A1 5/2005 Dreyer
2005/0117972 A1 6/2005 Dreyer

* cited by examiner

*Primary Examiner*—Frederick L. Lagman
(74) *Attorney, Agent, or Firm*—Nixon Peabody LLP

(57) ABSTRACT

A submersible boom that includes: a support system containing a substantially horizontal support member; a boom curtain formed of a flexible fabric material, the boom curtain being suspended from the substantially horizontal member; and means for raising and lowering the substantially horizontal support member between first (with the substantially horizontal support member at least partially above the surface of a body of water) and second (submerged) positions. Use of the boom in accordance with a method of allowing boat traffic ingress into and egress from a region within a body of water is also disclosed.

32 Claims, 7 Drawing Sheets

SUBMERSIBLE BOOM GATE

This application claims the benefit of U.S. Provisional Patent Application Ser. No. 60/557,995, filed Mar. 31, 2004, which is hereby incorporated by reference in its entirety.

FIELD OF THE INVENTION

The present invention relates to boom systems used in aquatic environments to limit the movement of contaminant solids or liquids, aquatic lifeforms, etc., and use thereof.

BACKGROUND OF THE INVENTION

Floating boom systems that are used for turbidity control, sediment containment, or contaminant containment, whether oil spill booms or debris booms, all have a common problem. If there is a need to provide ingress into and/or egress from a restricted region within a body of water, the floating boom systems lack the physical characteristics to allow partial temporary opening of the boom system to allow for movement of such traffic. By way of example, the need for traffic may come from the movement of sediment handling barges to transport their sediment load from a dredge area within the confines of the boom system to a location outside the boom system; or from the need to allow for frequent boat traffic when the boom system separates a mooring basin from the open body of water. Similar situations can be presented at water-intake structures where the boom system acts to filter water taken into the intake structures, but where the waterfront layout at the structure includes waterside loading/unloading facilities and access to the facilities is required for continued operation of the structure. Thus, a need exists for a boom system that is able to allow partial, temporary opening of the boom for movement of boat traffic.

The present invention is intended to overcome these and other deficiencies in the art.

SUMMARY OF THE INVENTION

A first aspect of the present invention relates to a submersible boom that includes: a support system containing a substantially horizontal support member; a boom curtain formed of a flexible fabric material, the boom curtain being suspended from the substantially horizontal support member; and means for raising and lowering the substantially horizontal support member between first (with the substantially horizontal support member at least partially above the surface of a body of water) and second (submerged) positions.

A second aspect of the present invention relates to a boom system that includes a plurality of boom sections, at least one of which is a submersible boom according to the first aspect of the invention.

A third aspect of the present invention relates to a method of allowing boat traffic ingress into and egress from a region within a body of water. This method of the present invention is carried out by providing a submersible boom of the present invention installed in a body of water, with the substantially horizontal support member positioned at least partially above the water surface to define a region within the body of water; and then submerging the submersible boom, or a portion thereof, for a period of time sufficient to permit boat traffic ingress into and/or egress from the region.

A boom system that can be raised and lowered as desired to overcome the above-identified deficiencies in the art will allow for transit as required yet substantially maintain the containment/exclusion properties of the boom system because the boom system will largely remain in a non-submerged position. That is, with its substantially horizontal support member at least partially above the surface of a body of water. This invention is particularly useful in connection with large dredging operations where it is desirable to minimize the spread of contaminated particulate matter from the dredge site yet multiple dredge barges are need to remove contaminated material from the site. By submerging only a small portion of the boom system for a short duration (i.e., sufficient for ingress or egress), it is possible to minimize the spread of contaminants from the dredge site into the larger body of water.

BRIEF DESCRIPTION OF THE DRAWINGS

FIG. 6A is an elevational view, and FIG. 6B is an enlarged perspective view of the upper end of the boom curtain, which contains an inflatable/deflatable bladder within the upper sleeve thereof.

DETAILED DESCRIPTION OF THE INVENTION

Figure 1:
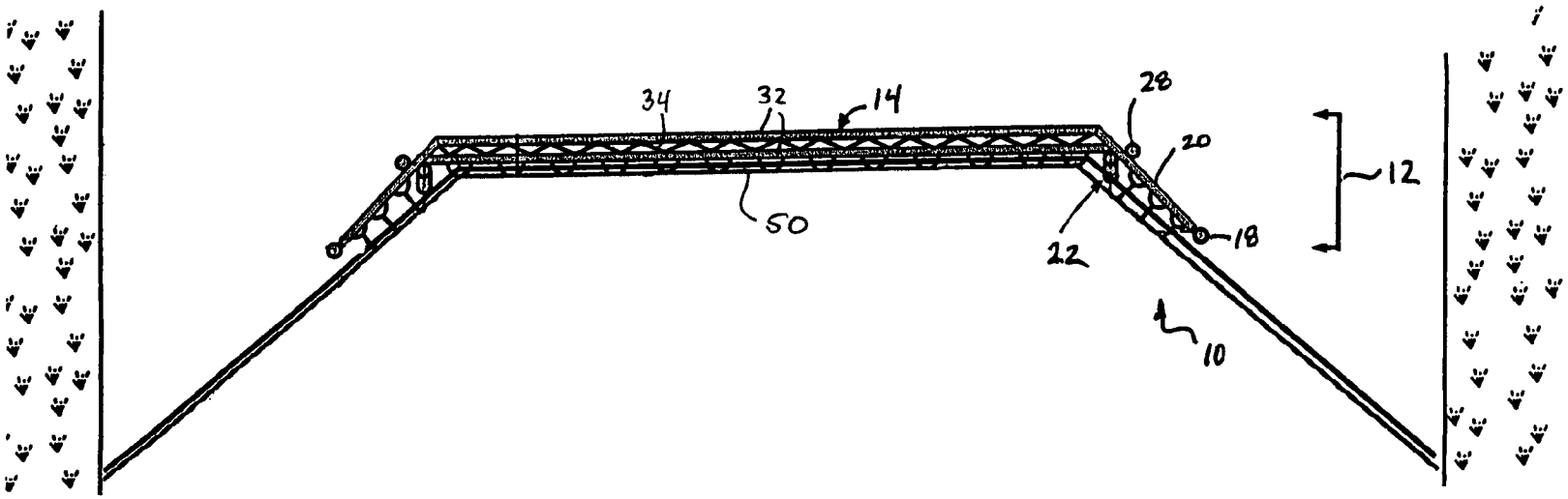
FIG. 1 is an environmental plan view of a submersible boom in accordance with one embodiment of the present invention.

A submersible boom of the present invention includes a support system (i.e., installed or capable of being installed within a body of water) that contains a substantially horizontal support member, a boom curtain formed of a flexible fabric material that is suspended from the substantially horizontal support member, and means for raising and lowering the substantially horizontal support member between first and second positions (i.e., at least partially floating and entirely submerged positions). The first and second positions can be separated by an distance that is suitable to allow for ingress and egress of boat traffic within a particular site of installation. In addition, the portion of the boom that is submersible can be substantially the entire length of the boom or merely a section or portion thereof According to one embodiment of the boom 10, illustrated in FIG. 1, the support system 12 includes a substantially horizontal support member 14 that is connected at its opposite ends to first and second hinge members, generally denoted as 16. The hinge members each include a substantially vertical hinge pile 18, and a draw bar 20 pivotally connected at one end thereof to the substantially vertical hinge pile and connected at the opposite end thereof to the substantially horizontal support member. In addition, a guide pile 22 is provided in close proximity to the draw bar. The guide pile 22 is positioned angularly with respect to the hinge pile 18. The guide pile 22 can be provided with first and second stop elements 24, 26. The first stop element 24 acts as an upper limit on draw bar 20 travel, whereas the second stop element 26 acts as a lower limit on draw bar 20 travel. Hence, the draw bar is pivotal between the first and second positions, which correspond to the first and second positions of the substantially horizontal support member. Depending on the type of substantially horizontal support member employed (discussed hereinafter), the first stop element can be optional.

Another component of the support system is an optional keeper pile 28 that is intended to abut against the draw bar 20, maintain its alignment, and prevent damage to the pivotal draw bar/hinge pile connection.

Figure 2:
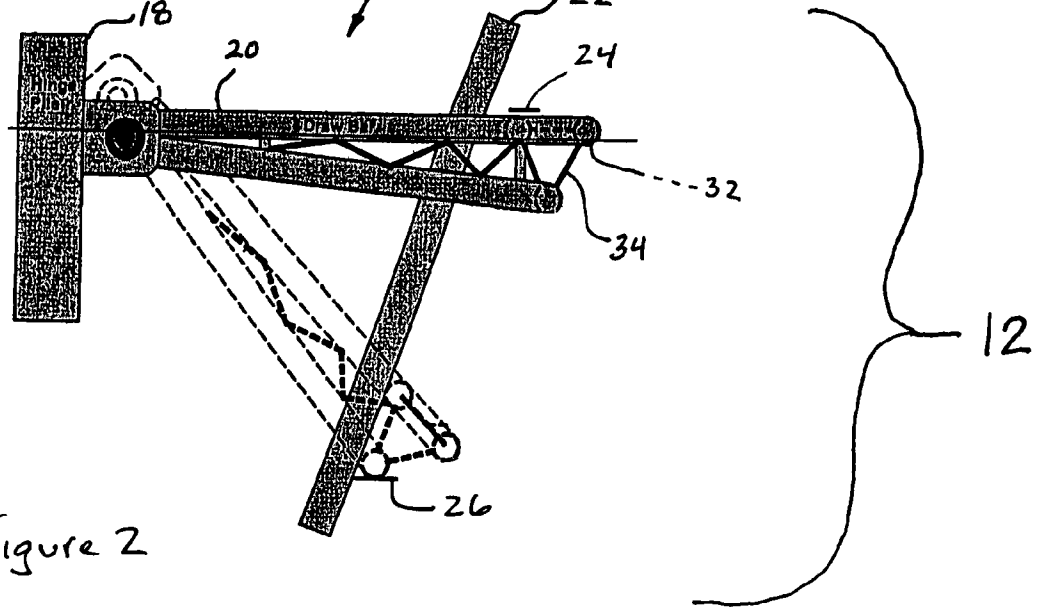
FIG. 2 is a side elevational view of a hinge member, also shown in FIG. 1, that provides support for the transition portion of the boom that will rise and fall. The hinge member prevents sheer forces from tearing the fabric material that forms the boom curtain. The position of the hinge member is illustrated in its upper position (for floating boom) and shown in phantom in its lower position (for submerged boom).
Figure 3:
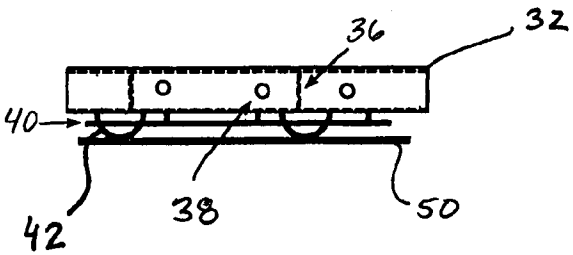
FIG. 3 is a partial, plan view of a horizontal support member in the form of a manifold with diaphragm plates, a supply hose for delivery of compressed gas, and loop connectors for tying the manifold to the boom curtain.

As shown in FIGS. 1–3, the substantially horizontal support member includes three manifolds 32 that are tethered together via webbing 34. As illustrated in FIG. 3, the manifolds 32 include a plurality of diaphragm plates 36 that define a series of chambers having discharge holes 38 (i.e., on the underside). A feeder line 40 is in communication between a source of compressed gas (e.g., air) and each of the chambers, allowing for delivery of the compressed gas into the chambers.

The boom curtain 50 is tethered to the manifolds 32 and draw bar 20 via connectors 42. The connectors 42 can be a rigid connector, elastic or inelastic lashing, or other webbing that ties the curtain to at least one of the manifolds 32. The feeder line can also be supported by the connectors 42 as well.

The boom curtain 50 can be formed of liquid pervious fabric material or liquid impervious fabric material. For most operations, it is desirable to utilize geosynthetic fabrics. Geosynthetic fabrics are formed of polymeric materials and can be either woven or non-woven. The geosynthetic fabric is "water-pervious" or permeable to water, meaning that water passes through the fabric and is not absorbed by the fabric.

Typically, the geosynthetic fabric can also absorb or attract oil (more generally, hydrocarbons), thereby blocking the flow of oil but allowing water to flow therethrough. For containment of silt and other suspended particulates, it is not essential that the fabric absorb oil.

Useful geosynthetic fabrics are further characterized by high load distribution capacity and the ability to abate material filtration. Geosynthetic fabrics are commercially available in a range of tensile strengths, permeabilities, and permitivities, and are useful for the purposes of the invention throughout those ranges. The geosynthetic fabrics are non-biodegradable, so they do not deteriorate due to environmental exposure. During prolonged use, exposure to ultraviolet (UV) light may cause some geosynthetic fabrics to weaken or deteriorate. However, UV-resistant fabrics are commercially available as well as UV resistance treatment methods.

Geosynthetic fabric may be prepared using one or a combination of various polymers, for example polyester, polypropylene, polyamides, and polyethylene. Most commercially available geosynthetic fabrics are polypropylene or polyester. Examples of suitable nonwoven geosynthetic fabrics include, but are not limited to, AMOPAVE® 4399, AMOPAVE® HD 4597, 4545, 4553, and 4561 (all polypropylene fabrics commercially available from Amoco Fabrics and Fibers Company); Typar®, a polypropylene fabric commercially available from Dupont; TREVIRA® Spunbond, a polyester fabric commercially available from Hoechst Fibers Industries. Examples of suitable woven geosynthetic fabrics include, but are not limited to, 1380 SILT STOP®, 1198, 1199, 2090, 2000, 2006 (all polypropylene fabrics commercially available from Amoco Fabrics and Fibers Company). The geosynthetic material XR-5 is preferred for terminal or other portions of the boom curtain that will be exposed to shear forces during raising and lower of the boom.

For most applications, it is sufficient to construct the boom curtain with a single layer of geosynthetic fabric. However, for some applications a multilayer construction may be desirable to provide added strength or protection against abrasion. The layers could be of the same geosynthetic fabric or different fabrics. For instance, a curtain might have a first layer of nonwoven fabric and a second layer of a woven fabric, which would tend to be more abrasive-resistant than the nonwoven fabric. The fabric can optionally be custom designed to provide for greater or lesser water flow therethrough, as described in U.S. Pat. No. 6,485,229 to Gunderson et al., which is hereby incorporated by reference in its entirety.

According to one curtain construction, two sheets of flexible fabric are used to form the curtain. The curtain can also be segmented into individual panels (i.e., at least two such panels) by stitching, heat sealing, or otherwise physically connecting the two sheets together. When a two-layered (or multi-layered) construction is employed for the curtain, the boom can also be equipped with a gas injection system which includes a source of compressed gas in fluid communication with at least one outlet positioned between the two layers of flexible material. A gas injection system of this type is disclosed in U.S. Pat. No. 6,485,229 to Gunderson et al., which is hereby incorporated by reference in its entirety. When the two-layered (or multi-layered) sheets of flexible fabric are segmented into individual panels, each panel may be equipped with its own outlet of the gas injection system. The gas injection system can used to clean the curtain of sediments and remove aquatic organisms to prevent impingement. The bubbling action of the air rising up through the sheets of fabric layers cleans the fabric of any sediment and/or aquatic life, which may be impinged. This gas injection system can be the same system as the system utilized for regulating position of the boom or a separate and distinct system.

Figure 4:
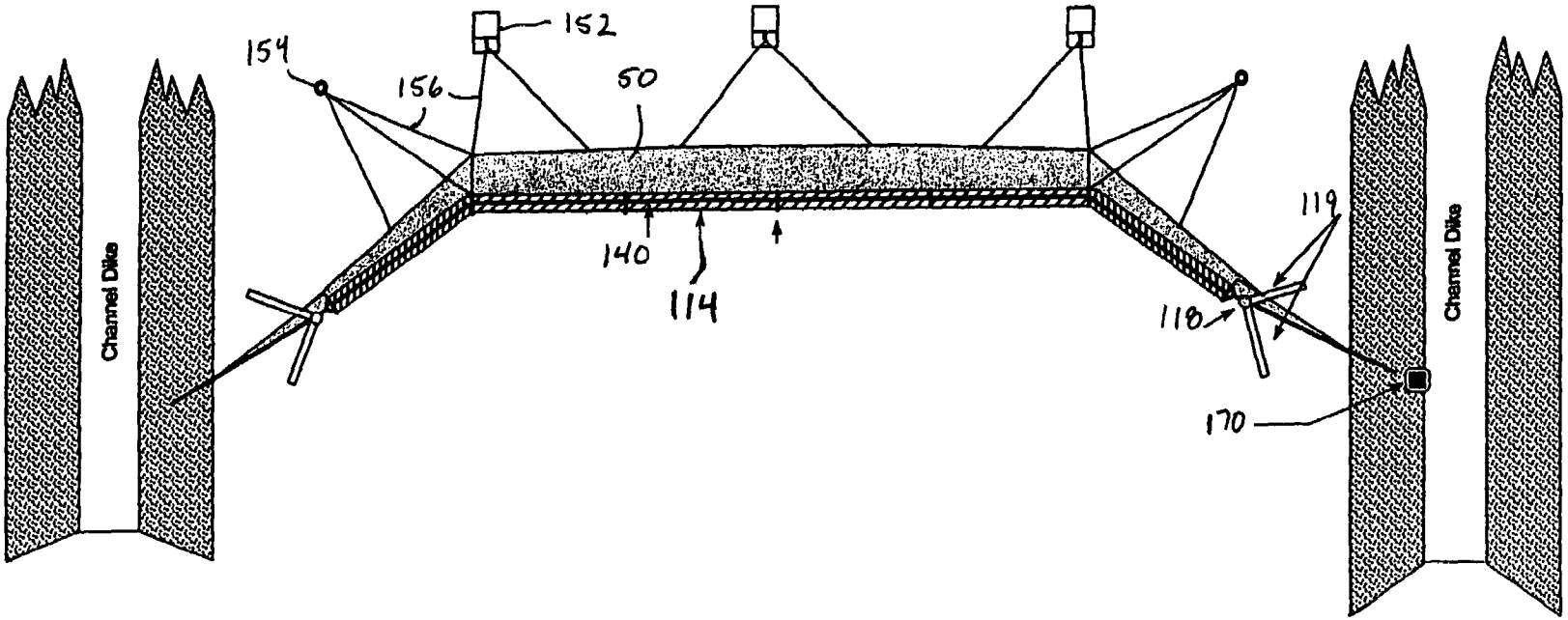
FIG. 4 is an environmental plan view of a submersible boom in accordance with a second embodiment of the present invention.
Figure 5:
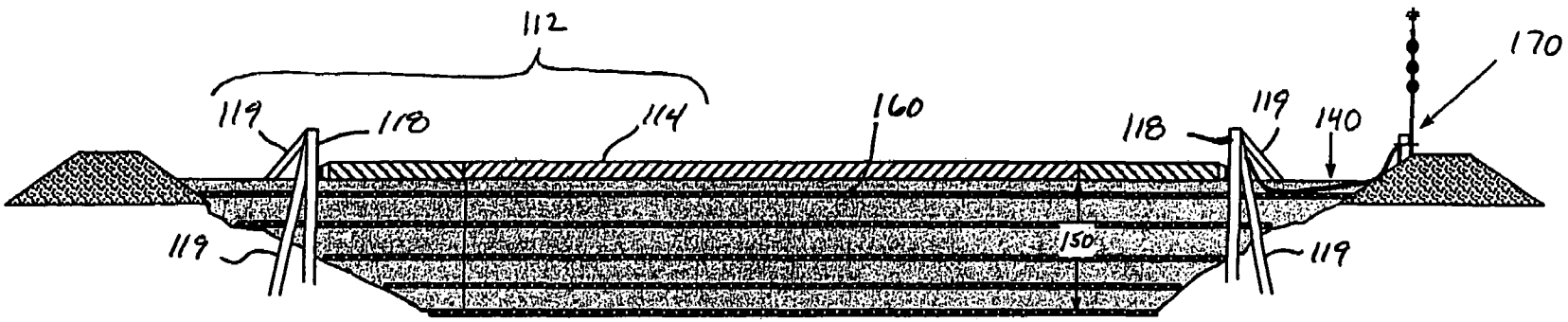
FIG. 5 is an environmental elevational view of the embodiment shown in FIG. 4.

According to another embodiment, illustrated in FIGS. 4 and 5, the support system 112 includes a substantially horizontal support member 114 that is connected at its opposite ends to substantially vertical piles 118, which are supported by batter piles 119. In this embodiment, the substantially horizontal support member 114 is a solid pipe floatation assembly that is adjustably buoyant in a manner like that described above for support member 14. The vertical pile 118 is preferably located a distance away from the shoreline (or dike) such that the curtain fabric can sustain tensile stresses applied thereto during repeated lowering and raising of the horizontal support member 114. Typically, the length of the terminal section of boom curtain should be at least about 3 times greater than the intended vertical drop of the submersible section, more preferably about 4 to 6 times greater in length. The boom curtain 150 can be of any construction described above for boom curtain 50.

As shown in FIG. 4, a number of supports are provided for boom curtain 150, including anchors 152, pile 154, and tether lines 156 (which is preferably formed of steel cable of suitable strength)

In FIG. 5, the curtain 150 is intended to be submerged over substantially its entire length. The boom curtain is therefore provided with ballast sleeves 160 containing suitable ballast material, e.g., chain, steel cable, etc.

In each of these embodiments, the substantially horizontal support member 14 or 114 is characterized by an adjustable buoyancy. That is, the substantially horizontal support member can be made to be buoyant or made to be negatively buoyant, as desired for purposes of raising and lowering the substantially horizontal support member.

As noted briefly above, a feeder line 40, 140 forms a portion of a gas (e.g., air) injection system that is provided. The gas injection system also includes a compressor (or source of compressed gas), and a suitable arrangement of valves (e.g., pairs of one-way valves) positioned between the compressor and the one or more chambers. Where pairs of one-way valves are utilized, one of the valves controls flow of gas from the compressor to the one or more chambers and the other valves control the venting of gas from the one or more chambers.

Thus, when the boom is intended to remain floating, compressed gas can be maintained in the tube or manifold by maintaining closed the valve that controls venting. The compressor and the valve that controls charging can be periodically operated, as desired to ensure that the boom maintains it positive buoyancy. Sensor elements can be provided to automate the process. Yet when the boom is intended to be submerged, the valve that controls venting is opened (and the valve that controls charging is maintained closed), allowing water to flow into the one or more chambers. Air continues venting until all of the chambers are substantially filled with water, causing the boom to sink until the draw bar contacts the second stop element. When the boom is intended to be raised, the one or more chambers are again charged with air (as above), and the water ballast is purged from the one or more chambers through the discharge holes.

The compressor and valves are preferably under control of a microprocessor that is equipped with a remote sensing device. Thus, an operator equipped with a transmitter can remotely signal to the microprocessor and remote sensing device for lowering of the boom, at which time the venting valve opens to allow for flooding of the one or more chambers as described above. Purging the ballast from the one or more chambers can either occur following a preset time delay (of several minutes or longer) or at the control of the operator (i.e., after boat traffic has cleared). The operator will signal to the microprocessor to operate the compressor to allow for purging of ballast as described above.

The microprocessor can be further integrated into a signaling system (red, yellow, and green lights) that indicate the safety status for traveling over the boom. Thus, an operator can visually determine the status of the boom movement by watching the signaling system.

As shown in FIGS. 4 and 5, control pad 170 generally designates the source of compressed gas (e.g., the compressor), the microprocessor, and signaling equipment. This control system can be provided in each of these embodiments (as well as the several embodiments described below).

Figure 8:
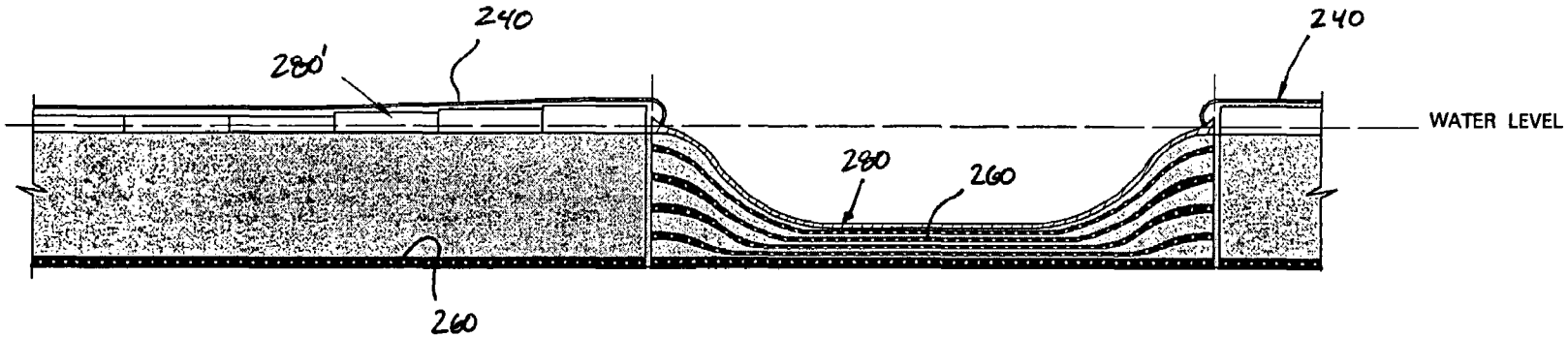
FIG. 8 is an elevational view of the embodiment shown in FIG. 6A, with the submersible portion of the boom having its air bladders deflated to allow for submersion thereof.

Referring now to FIGS. 6A, 6B, 7 and 8, another embodiment of the boom system is shown. In this instance, only a portion of the boom system is intended to be submersible. The remainder of the boom is intended to maintain its position over the entire water column. In this embodiment, the boom curtain 250 is provided with an upper sleeve 280 that contains one or more bladders 282. The bladders 282 are individually connected to a source of compressed gas and valves via feeder line 240. The compressor and valves are preferably under control of a microprocessor as described above. Consequently, the inflation and deflation of the plurality of air bladders can be used to adjust the buoyancy thereof. To encourage sinking of the boom when the plurality of bladders are deflated, ballast (e.g., in the form of chains or other weights) is retained within ballast sleeves 260. The total amount of ballast is selected to allow for sinking upon deflation, yet the weight does not overcome the buoyancy of the inflated air bladders. The submersion of the portion of the boom is illustrated in FIG. 8.

Figures 6A, 6B:
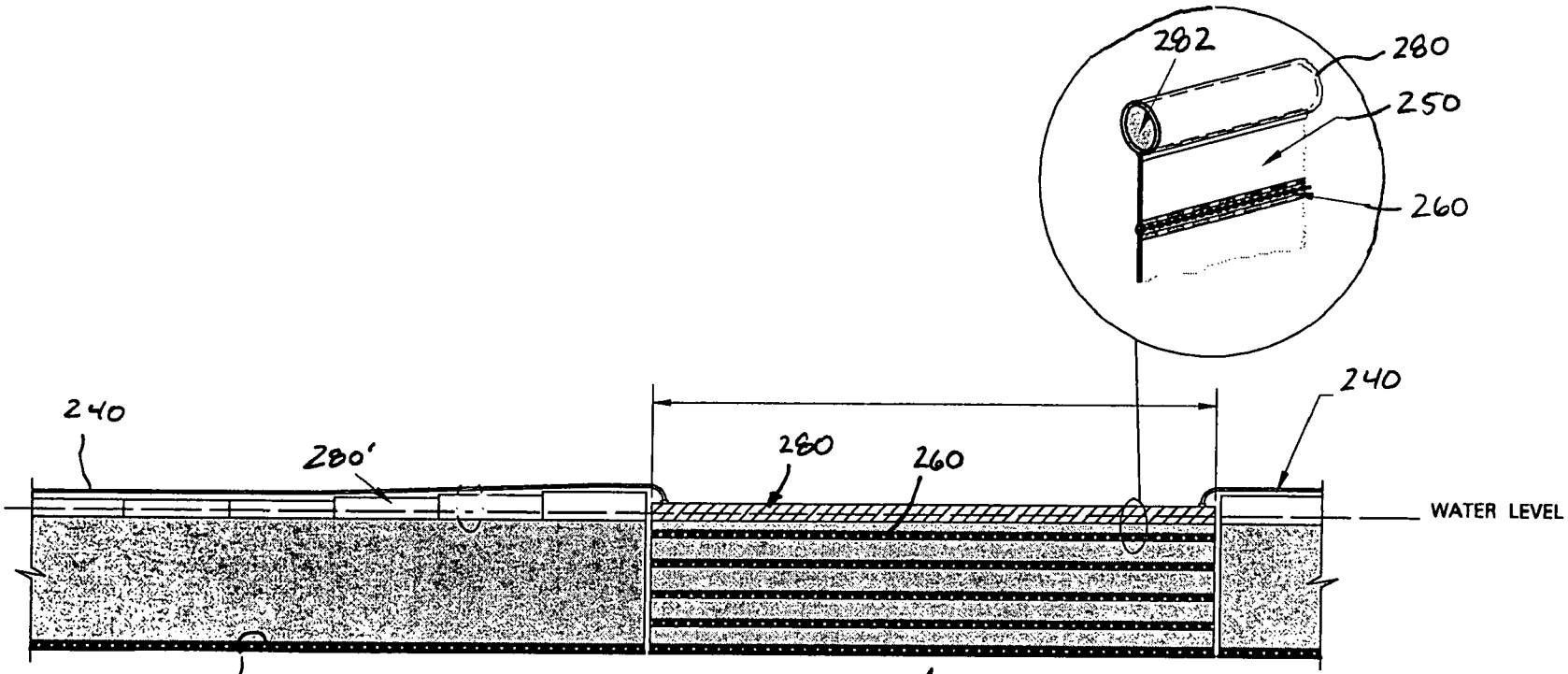
FIGS. 6A–B illustrate a submersible boom in accordance with a third embodiment of the present invention.
Figure 7:
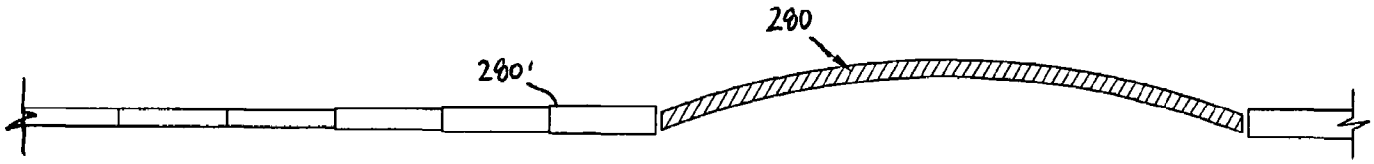
FIG. 7 is a plan view of the embodiment shown in FIG. 6A. The portion of the boom that is submersible is provided with extra slack, allowing the boom to bow outwards when floating, but allowing the curtain to be submerged without sheering thereof.

The portion of the boom that is not intended to be submerged also has upper sleeve portions 280' that contain standard flotation billets formed of polystyrene or the like. To provide added buoyant support for the regions adjacent to the submersible portion of the boom, the sleeves and flotation billets can be enlarged as shown in FIG. 6A. The portion boom that is not submersible can have a modified curtain design such that the curtain 250 contains only a lower ballast sleeve 260.

To allow for submersion of the portion of the curtain yet avoid destructive sheer forces acting upon the boom curtain during use, an excess of boom curtain material is provided for the submersible portion. Thus, the length of the boom curtain within the portion to be submerged is greater than the linear distance between the portions of the boom curtain that are not intended to be submerged. This is illustrated schematically in FIG. 7.

As yet another alternative, the substantially horizontal support member can have a substantially permanent buoyancy or negative buoyancy, and adjustment of the height or position of the boom can be controlled via a winch system.

Figure 9:
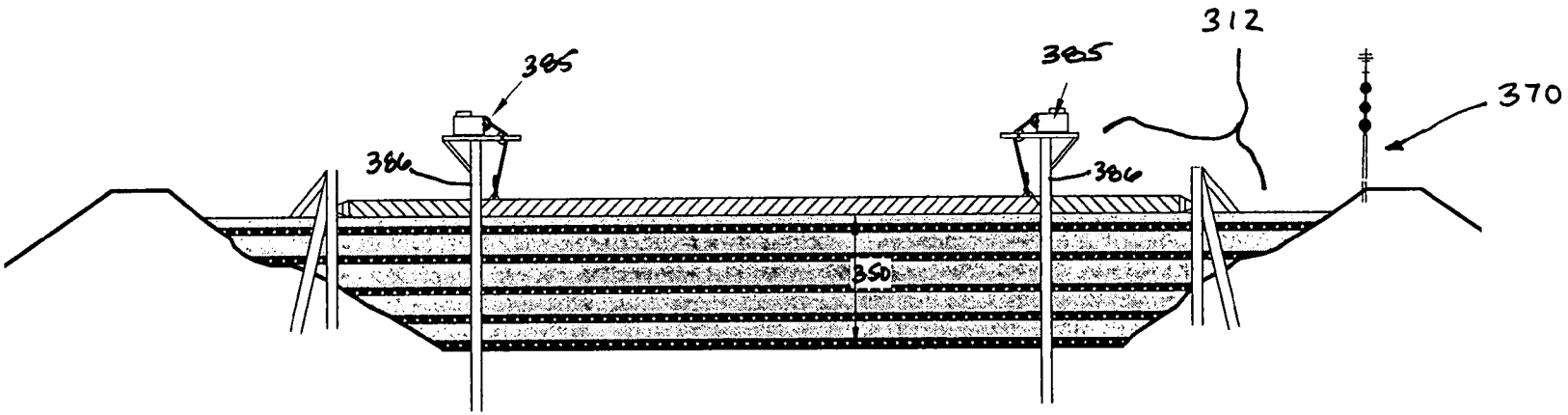
FIG. 9 is an elevational view of a submersible boom in accordance with a fourth embodiment of the present invention.

When provided with a negative buoyancy, the boom will desire to automatically return to its second (submerged or sunken) position. Hence, raising of the boom from a submerged position to a floating position will require force acting on the substantially horizontal support member in an opposite direction of its negative buoyancy. As illustrated in FIG. 9, this can be achieved by a winch system having lines rigged to the opposite ends (as well as at intermediate position, depending on its length) of the substantially horizontal support member. The boom system is of similar design as described above, including the curtain 350 (similar in design to curtains 150 and 250) and the support system 312. However, the support system also includes the motorized winch devices, generally designated 385, that are mounted upon a piling 386. The motor can be an electric motor, in which case the power supply is carried via cable (not shown) from a suitable power source. Where electrical power sources are not readily available, the motor can be gas or diesel powered. Regardless of its design and power source, the motor has sufficient power to be achieve the desired work. A cable of each winch device is connected to the upper edge of the substantially horizontal support member, allowing for lowering and raising of the boom curtain. During use, the one or more winches will pull the substantially horizontal support member upward against the force of its negative buoyancy. Lowering of the boom simply requires reverse operation of the winch, allowing the negative buoyancy of the substantially horizontal support member to return the boom to its second (submerged or sunken) position.

When provided with a positive buoyancy, the boom will desire to automatically return to its first (floating) position. Hence, lowering of the boom to a submerged position will require force acting on the substantially horizontal support member in an opposite direction of its buoyancy. This can be achieved by a winch system having lines rigged to the opposite ends (as well as at intermediate position, depending on its length) of the substantially horizontal support member. The winch will pull the substantially horizontal support member downward against the force of its buoyancy. (In such a design, a pulley is provided on the pile 386 submerged by at least he desired travel distance, with a cable passing around the pulley and connected to the substantially horizontal support member.) The winch is preferably operated by a motor having sufficient power to be achieve the desired work. Raising of the boom simply requires reverse operation of the winch, allowing the buoyancy of the substantially horizontal support member to return the boom to its first (floating) position.

In each of the above-described embodiments, it should be appreciated that the temporary lowering of the boom is, in particular, intended to allow ingress and egress boat traffic. The particular nature of the marine environment in which the system is installed, i.e., the type of boat traffic to be encountered, will largely dictate the size of the boom system, the depth to which the boom will be submerged, and the type of system to be utilized for raising and lowering of the boom. For many embodiments, clearance of up to about 12 feet is desirable, although commercial vessels may need greater clearance and recreational vessels may need less.

The boom of the present invention can also include additional features or components which are known and disclosed, for example, in U.S. Pat. No. 5,102,261 to Gunderson, III, which is hereby incorporated by reference in its entirety. Exemplary of such additional features or components include: tow cords, which are used for towing floating booms into position in a body of water or simply from one location to another; and connector straps (preferably with industrial hook-and-loop fastening strips), which are used to connect two lengths of the boom together to form a single continuous structure having overlapping curtain structures.

The boom curtain can also be fabricated using pleated curtains, as described in U.S. Pat. No. 6,743,367 to Dreyer, which is hereby incorporated by reference in its entirety.

Different portions of the boom curtain can be connected together using zipper connections, as disclosed in U.S. Pat. No. 6,739,801 to Dreyer, which is hereby incorporated by reference in its entirety.

Sewing or heat fusion of the geosynthetic material can be used to connect multiple sheets together to add additional height, or to attach the tow cords, stirrups for attaching chains or anchors lines, etc. The geosynthetic fabric can be sewn with a conventional industrial sewing machine, and heat fusion can be accomplished with an industrial iron. Heat fusion can also be accomplished by puncturing or piercing through the overlapped geosynthetic fabric with a soldering iron. Good, strong connections have been made this way.

The lower edge of the curtain is retained substantially against the bottom or floor of the body of water. Ballasts such as lengths of steel chain (from less than ⅛ inch to over ¾ inch) and steel cable (from less than ¾ inch to over 1½ inches in diameter) have been used. Of course, chains and cables of greater or less diameter may be used to meet the specific requirements of a project design. Alternatively, anchors and pilings in combination with cables can be used to maintain the bottom of the curtain against the bottom of the body of water.

The boom curtain can also include a Y-panel anchoring system as disclosed in U.S. Pat. No. 6,858,861 to Dreyer, which is hereby incorporated by reference in its entirety.

The curtain also has first and second ends that are anchored or otherwise secured to a shoreline. Conventional connections can be used for this purpose. Toward the ends of the curtain, the height of the curtain can appropriately taper while maintaining contact with the floor of the body of water.

To support the curtain and reduce tensile stresses applied to the curtain during raising and lowering of the boom, the curtain can include reinforcing members extending at least partially the length between the first end and the second end thereof. In particular, it is desirable to provide reinforcing members within the region between the connection to the shoreline and the portion of the curtain that is submerged the greatest distance. Exemplary reinforcing members can include cables or chains secured externally of the curtain.

To prevent the curtain from 'floating' upwards when the boom is submerged, which would otherwise be likely to result in interference with propellers of boats passing above the boom, the boom curtain can be provided with a plurality of substantially ballast sleeves at approximately two to four foot spacing. Ballast placed into these sleeves will sufficiently weigh down the curtain to prevent it from 'floating' to any significant extent while it is intended to remain submerged.

In use, a submersible boom of the present invention will be installed in a body of water, with its substantially horizontal support member positioned at least partially above the water surface to define a region within the body of water (also referred to as the first or floating position). Installation is generally achieved such that the region of the body of water, which is defined by the boom and intended to be isolated from the larger body of water, is substantially or entirely confined by the length or perimeter of the boom (i.e., when the boom remains in the floating position). As desired, the submersible boom can be submerged (referred to as the second or submerged position) for a period of time sufficient to permit ingress into and/or egress from the region by boat traffic.

Submersion and subsequent raising of the substantially horizontal support member can be carried out according to a variety of actions, depending on the nature of the substantially horizontal support member (i.e., whether it is buoyant, negatively buoyant, or reversibly buoyant), as described in the various embodiments described above.

Although several embodiments illustrate a single length of the submersible boom system, it should be appreciated that the submersible boom system can be used as a component part of a larger boom structure. Hence, a boom system can include permanent or semi-permanent non-submersible sections or segments in series with submersible sections or segments of the present invention. Moreover, it is possible for larger boom systems to contain two or more submersible sections or segments.

In another embodiment, two such boom systems can be used to define first (inner) and second (outer) regions within the larger body of water. This is particularly desirable to avoid release of contaminants from a dredging site (within the first region confined by an inner boom system) to the larger body of water. To allow movement of boats to and from a dredge site, for example, the second (outer) boom system will be submerged to allow boats to enter the second region between the first and second boom systems, and then raised, followed by submersion and raising of the first boom system to allow boats to enter the first region confined by the first boom system. To allow egress, the process is simply reversed. In this manner, one of the boom systems is always in place to minimize the spread of suspended dredge contaminants from the first region through the second region and into the larger body of water.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. A submersible boom comprising:

a support system comprising a substantially horizontal support member, and first and second hinge members positioned at opposite ends of the substantially horizontal support member, the first and second hinge members each comprising:

a substantially vertical hinge pile, and a draw bar pivotally connected at one end thereof to the substantially vertical hinge pile and connected at the opposite end thereof to the substantially horizontal support member;

a boom curtain formed of a flexible fabric material, the boom curtain being suspended from the substantially horizontal support member; and means for raising and lowering the substantially horizontal support member between first and second positions.

2. The submersible boom according to claim 1 wherein each of the first and second hinge members further comprise:

a guide pile comprising a first stop element that engages the draw bar when the substantially horizontal support member is in the first position and a second stop element that engages the draw bar when the substantially horizontal support member is in the second position.

3. The submersible boom according to claim 2 wherein each of the first and second hinge members further comprise:

a keeper pile that abuts against the draw bar.

4. The submersible boom according to claim 1 wherein the substantially horizontal support member is buoyant.

5. The submersible boom according to claim 4 where the means for raising and lowering the substantially horizontal support member comprise:

a winch connected to the support system and comprising a rigged line connected at one end to the winch and connected at the other end to the substantially horizontal support member, wherein the winch pulls the substantially horizontal support member against its buoyancy.

6. The submersible boom according to claim 1 wherein the substantially horizontal support member is negatively buoyant.

7. The submersible boom according to claim 6 where the means for raising and lowering the substantially horizontal support member comprise:

a winch connected to the support system and comprising a rigged line connected at one end to the winch and connected at the other end to the substantially horizontal support member, wherein the winch pulls the substantially horizontal support member against its negative buoyancy.

8. The submersible boom according to claim 1 wherein the substantially horizontal support member is adjustably buoyant.

9. The submersible boom according to claim 8 wherein the substantially horizontal support member is in the form of a tube that defines one or more chambers.

10. The submersible boom according to claim 9 wherein the means for raising and lowering the substantially horizontal support member comprise:

means for introducing ballast into the one or more chambers, and means for purging ballast from the one or more chambers.

11. The submersible boom according to claim 10 wherein the means for introducing ballast comprise:

one or more apertures formed linearly along a lowermost surface of the one or more chambers, and a release valve in communication with the one or more chambers.

12. The submersible boom according to claim 10 wherein the means for purging ballast comprise:

a source of compressed gas in fluid communication with the one or more chambers, and a valve positioned between the source of compressed gas and the one or more chambers.

13. The submersible boom according to claim 9 wherein the means for raising and lowering the substantially horizontal support member comprise:

means for introducing a gas into and removing the gas from the one or more chambers, thereby modifying the buoyancy of the tube; and ballast tethered to a portion of the boom curtain, whereby removal of the gas from the one or more chambers allows the ballast to cause submersion of the boom.

14. The submersible boom according to claim 13 wherein the means for introducing and removing a gas comprise:

a source of compressed gas in fluid communication with the one or more chambers, and a valve positioned between the source of compressed gas and the one or more chambers.

15. The submersible boom according to claim 1 further comprising:

a remote control device, and a remotely controlled operator of the means for raising and lowering the substantially horizontal support member.

16. The submersible boom according to claim 15 further comprising a signal device comprising at least two signals.

17. The submersible boom according to claim 1 wherein the boom curtain comprises a first end anchored to a shoreline and a second end anchored to a shoreline.

18. The submersible boom according to claim 17 wherein the boom curtain further comprises reinforcement members extending at least partially the length between the first end and the second end thereof.

19. The submersible boom according to claim 1 wherein the flexible fabric material is a geosynthetic material.

20. The submersible boom according to claim 1 wherein the boom curtain comprises first and second sheets of the flexible fabric material.

21. The submersible boom according to claim 20 further comprising:

a gas injection system comprising a source of compressed gas in communication with a plurality of outlets positioned between the first and second sheets of flexible fabric material.

22. A boom system comprising a plurality of boom sections, at least one of which is a submersible boom according to claim 1.

23. The boom system according to claim 22 wherein at least two of the submersible booms are present.

24. A method of allowing boat traffic ingress into and egress from a region within a body of water, said method comprising:

providing a submersible boom according to claim 1 installed in a body of water, with the substantially horizontal support member positioned at least partially above the water surface to define a region within the body of water; and submerging the submersible boom, or a portion thereof, for a period of time sufficient to permit boat traffic ingress into and/or egress from the region.

25. The method according to claim 24 wherein the submersible boom comprises a substantially horizontal support member that is buoyant, said submerging comprising:

pulling the substantially horizontal support member against its buoyancy to a submerged position.

26. The method according to claim 24 wherein the submersible boom comprises a substantially horizontal support member that is negatively buoyant, said submerging comprising:

removing a supporting force that is applied to the substantially horizontal support member to maintain a position at least partially above the surface of the body of water.

27. The method according to claim 24 wherein the submersible boom comprises a substantially horizontal support member that is adjustably buoyant, said submerging comprising:

flooding one or more chambers within the substantially horizontal support member with water.

28. The method according to claim 24 further comprising:

raising the submersible boom until the substantially horizontal support member is again positioned at least partially above the water surface.

29. The method according to claim 28 wherein the submersible boom comprises a substantially horizontal support member that is buoyant, said raising comprising:

removing a restraining force that is applied to the substantially horizontal support member to maintain a submerged position.

30. The method according to claim 28 wherein the submersible boom comprises a substantially horizontal support member that is negatively buoyant, said raising comprising:

pulling the substantially horizontal support member against its negative buoyancy to the position at least partially above the water surface.

31. The method according to claim 28 wherein the submersible boom comprises a substantially horizontal support member that is adjustably buoyant, said raising comprising:

purging ballast water from one or more chambers within the substantially horizontal support member.

32. The method according to claim 24 wherein a second submersible boom is provided, defining a second region within the body of water that encompasses the first region within the body of water, said method further comprising:

submerging the first and second submersible booms in succession, whereby only one boom is submerged at a time, to permit boat traffic ingress into and/or egress from the region and the second region.

* * * * *